US006260937B1

(12) United States Patent
Sugahara

(10) Patent No.: US 6,260,937 B1
(45) Date of Patent: Jul. 17, 2001

(54) INK JET PRINTING APPARATUS AND ADJUSTABLE DRIVING METHOD FOR THE INK JET PRINTING APPARATUS

(75) Inventor: Hiroto Sugahara, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/391,234

(22) Filed: Sep. 7, 1999

(30) Foreign Application Priority Data

Sep. 10, 1998 (JP) ..... 10-256180

(51) Int. Cl.[7] ..... B41J 2/01; B41J 2/12; B41J 2/51

(52) U.S. Cl. ..... 347/14

(58) Field of Search ..... 347/14, 5, 9

(56) References Cited

U.S. PATENT DOCUMENTS 5,138,344 * 8/1992 Ujita ..... 347/14
5,812,156 * 9/1998 Bullock et al. ..... 347/14
5,956,052 * 9/1999 Udagawa et al. ..... 347/14
6,019,449 * 1/2000 Bullock et al. ..... 347/14

* cited by examiner

*Primary Examiner*—Huan Tran
(74) *Attorney, Agent, or Firm*—Oliff & Berridge, PLC

(57) ABSTRACT

Data of the ejection speed of the ink droplets ejected from the ink jet head is provided to the ink jet head of the ink jet printer. When the printing operation is made, data is read from a ROM and the ejection timing of the ink droplets is controlled based on the data. Thereby, even if difference in the size of the ink channels or the nozzles of the ink jet head is generated in their manufacturing process, the adhering position of ejected ink onto the paper can become precise.

24 Claims, 7 Drawing Sheets

CLK
t1
t2
t1
t1
t1

2A
2B
2C
2D 2A
2B
2C
2D

MOVEMENT DIRECTION OF HEAD

INK JET PRINTING APPARATUS AND ADJUSTABLE DRIVING METHOD FOR THE INK JET PRINTING APPARATUS

BACKGROUND OF THE INVENTION

1. Field of Invention

The invention is related to an ink jet printing apparatus and an adjustable driving method for the ink jet printing apparatus.

2. Description of Related Art

There has been an ink jetting device having an ink jet head formed with piezoelectric ceramics as an ink jetting device used for an ink jet printer. A plurality of ink channels spaced by the piezoelectric ceramics are provided in this type of ink jet head. An ink cartridge storing ink is connected to one end of each ink channel and the ink stored in the ink cartridge is supplied to the ink channel. A nozzle for ejecting the ink in the ink channel is provided to the other end of each ink channel.

When ink droplets are ejected from the ink channel, a voltage corresponding to a driving signal is applied to the piezoelectric ceramics to deform the piezoelectric ceramics. The capacity of the ink channel is changed by the deformation. When the capacity of the ink channel is decreased, the ink in the ink channel is ejected from the nozzle, and when the capacity of the ink channel is increased, the ink in the ink cartridge is introduced to the ink channel. The ink ejected from the nozzle is printed on the paper as a character or a figure.

Although the ink jet head is made with very high accuracy, it is impossible to completely prevent variation in the size of the ink channel or the nozzle for each ink jet head. Therefore, the size of the ink channel or the nozzle is different for each ink jet head. If the size of the ink channel is different for each ink jet head, the deformation amount of the ink channel becomes different when the same driving voltage is applied to the piezoelectric ceramics. If the deformation amount of the ink channel is changed, the voltage applied to the ink in the ink channel at the time of change of the capacity of the ink channel is changed, therefore, the ejecting speed of the ink is changed. Further, if the size of the nozzle is different, the amount of the ejected ink or the ejecting speed is changed.

If the ejecting speed is changed as described above, the following problem is caused. When the ink jet head moves along the paper reciprocately to eject ink droplets, the adhering position of the ink droplet on the paper becomes different when the ink jet head moves forward and when the ink jet head moves back. Especially, in a multi-color ink jet printer provided with a plurality of ink jet heads corresponding to each color, the adhering position of the ink droplets of each color becomes different and therefore, printing with high quality cannot be performed.

Thus, the manufacturing error of all ink jet heads must be within a range of the predetermined tolerance to maintain predetermined printing quality in any ink jet head, and it has been necessary to manage the size of the ink channel or nozzle with strict tolerance in the manufacturing process of the ink jet head.

SUMMARY OF THE INVENTION

The invention concerns maintaining fixed printing quality in any ink jet head without management of the strict tolerance. The ink jet printing apparatus of the invention includes a memory for storing any one of data relating to the ejection speed of ink droplets, data relating to the ejection speed difference between each of the ink jet heads, and data relating to the ejection timing difference based on the ejection speed, and a controller that applies an ejection signal to the ink jet head at a predetermined ejection timing based on the data stored in the memory.

Thus, even if the ink channels or the nozzles of the ink jet head have a different size because of the manufacturing error, the effect of the size difference upon the ink jet head can be cancelled by the data stored in the memory. Therefore, the adhering position of the ink droplets ejected from the ink jet head becomes the same and high quality printing becomes possible.

The memory can be uniformly provided to the ink jet head and detachable uniformly with the ink jet head from the printing apparatus. Thus, when the ink jet head is exchanged, the ejection signal is applied to the exchanged ink jet head at a predetermined ejection timing based on the data stored in the memory provided uniformly to the exchanged ink jet head. Therefore, after the ink jet head is exchanged, the printing quality can be maintained.

The following method can be considered as a method for determining the ejection timing of the ink droplets. A first step for detecting data of ejection speed of the ink droplets for each ink jet head is carried out. Next, a second step for determining ejection timing for each ink jet head based on the data of the ejection speed is carried out. Then, the difference of the ejection speed of the ink droplets caused by the size difference of the ink channels or the nozzles of the ink jet head is eliminated and the adhering position of the ink droplets on the paper becomes identical so that the printing quality is unified.

In the above-described first step, printing is performed by moving the ink jet head along the paper maintaining a predetermined space therebetween to measure the ejection speed of the ink droplets by the difference of the printing position.

At this time, the position of dots printed on the paper by the printing operation is determined by the movement speed of the ink jet head and the ejection speed of the ink droplets. The ejection speed of the ink droplets can be obtained by measuring difference between the position of the printed dots and the theoretical printing position.

That is, because the movement speed of the ink jet head is fixed, if the ejection speed of the ink droplets is almost same in all ink jet heads, printing is made at a predetermined position. On the other hand, if the ejection speed of the ink droplets in a selected ink jet head is different from the ejection speed of the ink droplets in other ink jet heads, the printing position is different from the predetermined position in one direction that the ink jet head moves or in its opposite direction when the ink jet head moves back. Therefore, by determining a reference ink jet head in advance, when the difference between the printing position of the droplets ejected from the selected ink jet head and the printing position of the droplets ejected from the reference ink jet head becomes large, the speed difference between the ejection speed of the ink droplets of the selected ink jet head and the ejection speed of the ink droplets of other ink jet heads becomes large. The ejection speed of the ink droplets ejected from the selected ink jet head can be obtained by obtaining the speed difference.

In a third step following the second step, data corresponding to the ejection timing determined in the second step is stored in the memory uniformly provided to the ink jet head. The driving voltage is applied to the ink jet head at the ejection timing stored in the memory so as to eject ink at an ejection timing which is different for each ink jet head. As a result, the printing quality is not different for each ink jet head and fixed printing quality can be obtained in any one of the ink jet heads.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

A preferred embodiment is explained with reference to the figures as follows.

Figure 1:
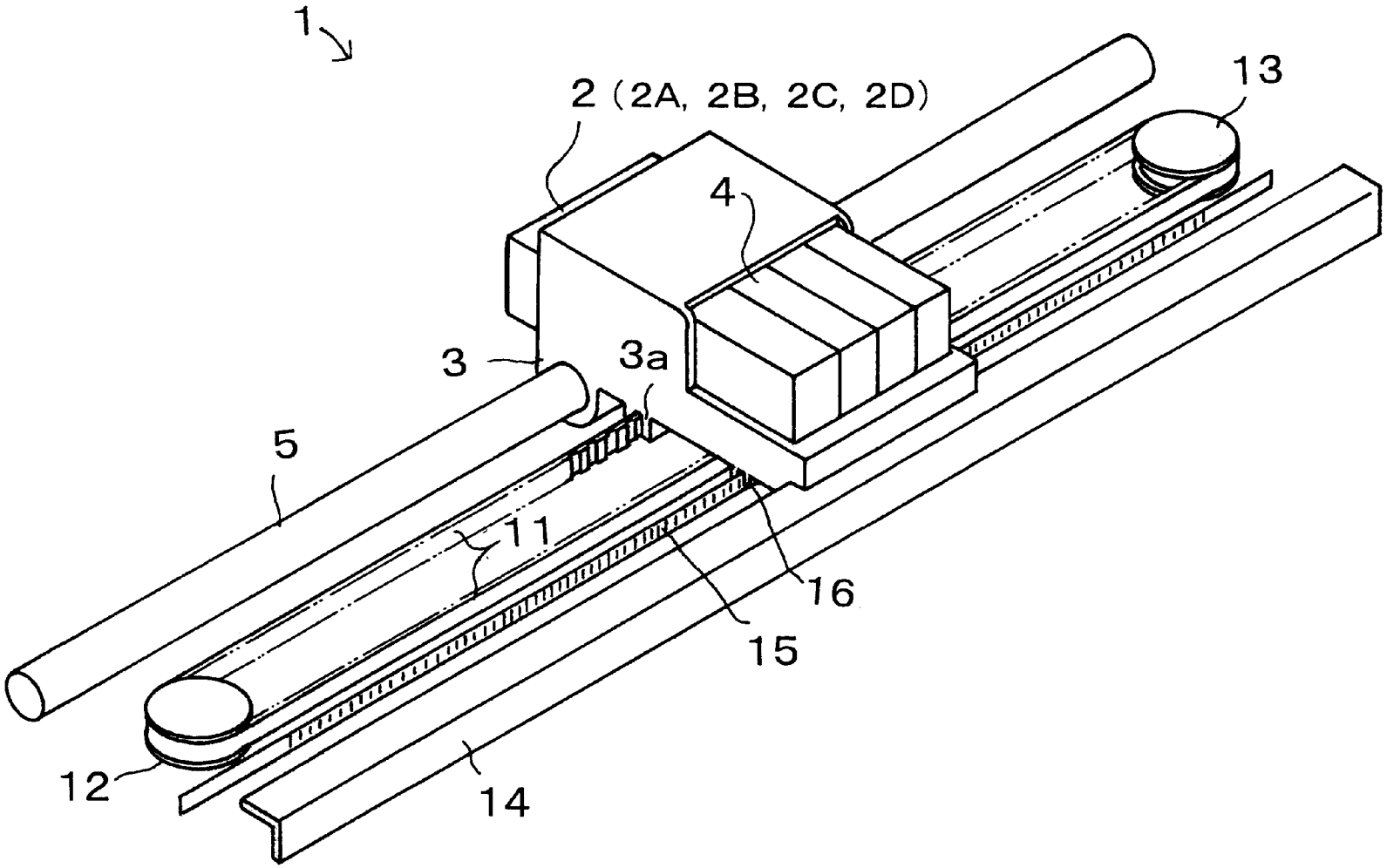
FIG. 1 is a general structural view of an ink jet printing apparatus according to the invention.

In FIG. 1, a color ink jet printing apparatus I is provided with an ink jet head assembly 2 for ejecting ink droplets by application of an ejection signal to an actuator with a predetermined timing to print a character or figure on a paper. The ink jet head assembly 2 is mounted on a carriage 3 that is reciprocately movable. Ink is supplied to the ink jet head assembly 2 from an ink cartridge mounted on the carriage with the ink jet head assembly 2 and storing ink. The ink jet head assembly 2 comprises a head 2A, head 2B, head 2C and head 2D corresponding to yellow, magenta, cyan and black (See FIGS. 7–9D).

The carriage 3 is provided slidably to a guide rod 5 that is arranged parallel along a platen roller (not shown). The lower end part 3*a* of the carriage 3 is connected to an endless timing belt 11. The timing belt 11 is wound around a driving pulley 12 and a following pulley 13 arranged with a predetermined space therebetween. When a stepping motor (not shown) is driven to be rotated for driving the carriage 3, via the timing belt and both pulleys 12, 13, the carriage 3 is moved reciprocately along the paper with a predetermined space from the paper and supported by the guide rod 5. The end part of the carriage 3 is supported by a guide rail 14 so as to be movable in the left and right direction.

An encoder part 15 made of a thin film and having a belt shape extending in the left and right direction is provided horizontally below the carriage 3. A photo sensor 16 of a pair of a light emitting element and a light receiving element is provided on the lower side of the carriage 3 so as to face the encoder part 15 to detect optically a position of the carriage 3.

Figure 2:
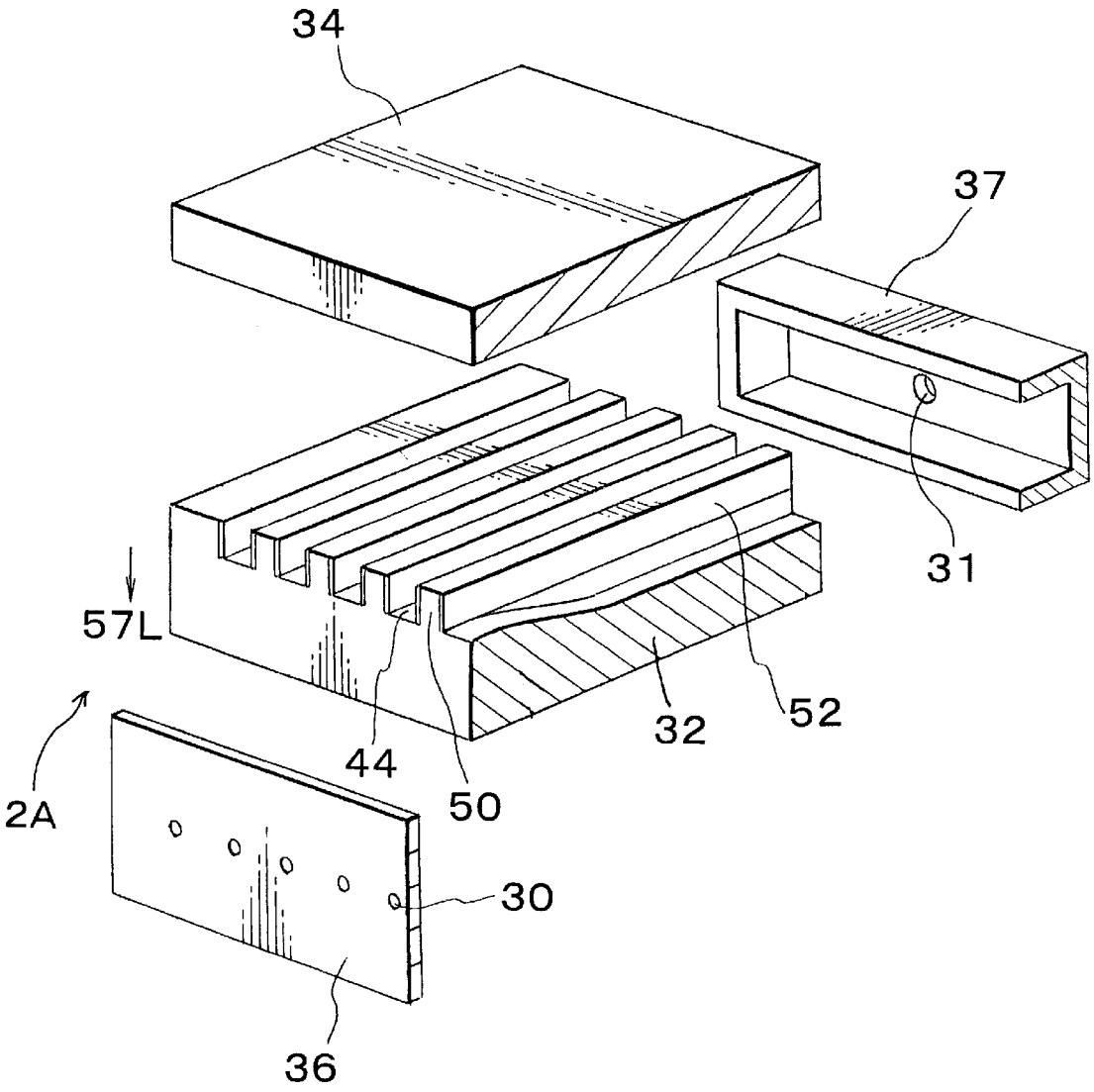
FIG. 2 is an exploded perspective view of an ink jet head according to the invention.

The ink jet head 2A is illustrated as an exemplary ink jet head in FIG. 2, has an actuator base plate 32, a plate member 34, a nozzle plate 36, and a manifold member 37. The actuator base plate 32 is formed of a piezoelectric material comprising a lead zirconate titanate based ceramic material. On one surface of the actuator base plate, a plurality of ink grooves 44 formed by cutting with a diamond blade or the like are provided. As the piezoelectric material, a lead titanate based ceramic material may be used.

The ink grooves 44 are arranged in parallel via side walls 50 polarized in the thickness direction 57L of the actuator base plate 32. In an upper part of the wall surface of the side wall 50, an electrode 52 is formed across both ends of the side wall 50 by vacuum deposition or plating so as to apply an electric field in a direction perpendicular to the direction 57L.

Figure 3:
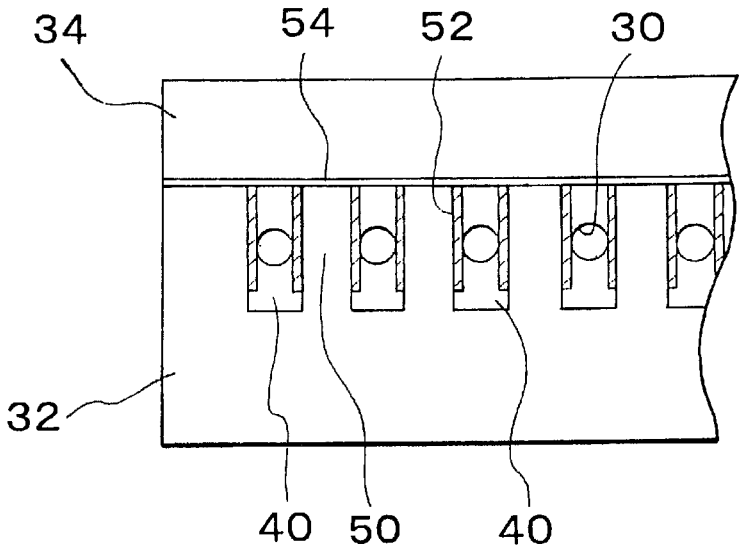
FIGS. 3 is an explanatory cross sectional view showing ink channels of the ink jet head of the invention.

To one surface of the actuator base plate 32, a flat plate-shaped plate member 34 comprising a ceramic material or a resin material is bonded by the use of an epoxy adhesive. The plate member 34 is adhered to one surface of the side wall 50 in a liquid-tight condition via an adhesive layer 54, as shown in FIG. 3. By covering the groove opening of the ink groove 44, the plate member 34 defines an ink channel 40 which serves as an ink channel having a rectangular cross section. To one end (front end) of the actuator base plate 32 and plate member 34 that constitute the ink channel 40 in this manner, a nozzle plate 36 is bonded using the above-mentioned epoxy adhesive. The nozzle plate 36 is formed from a plastic material such as polyalkylene (e.g., polyethylene) terephthalate, polyimide, polyether imide, polyether ketone, polyether sulfone, polycarbonate or cellulose acetate.

Figure 4:
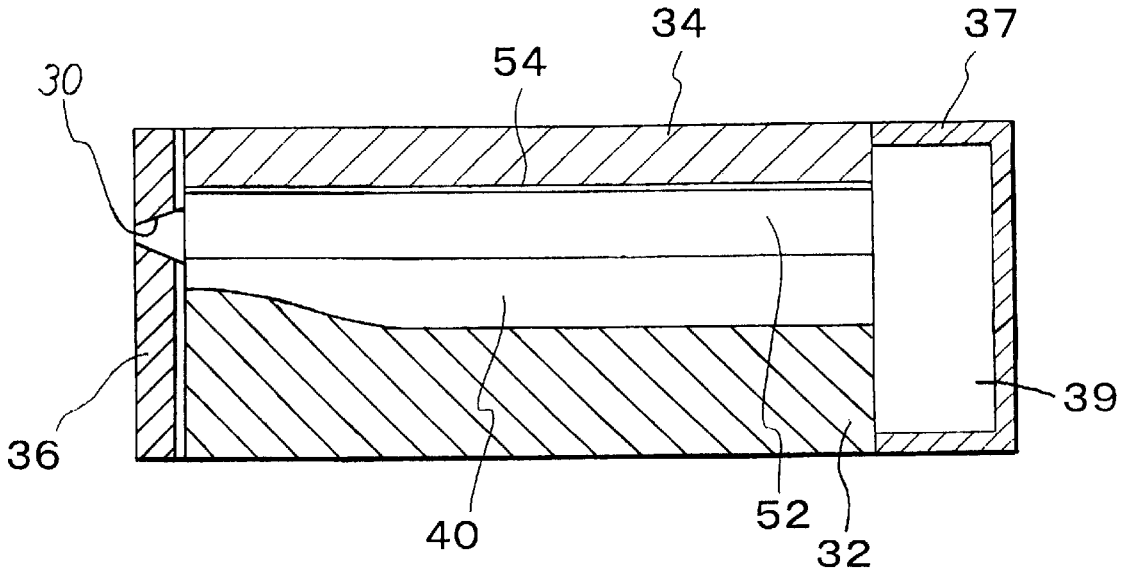
FIG. 4 is a longitudinal sectional view of the ink jet head shown in FIG. 2.

In the nozzle plate 36, a nozzle 30 is formed in agreement with the ink channel 40 so as to communicate with each other. The nozzle 30 is in a nearly truncated conical shape. As shown in FIG. 4, its bore increases from the exit side toward the ink channel 10 side, reaching nearly the maximum diameter that can be set for the channel cross section of the ink channel 40, at the end face on the ink channel 40 side. That is, the nozzle 30 is formed with a diameter which defines a circle nearly inscribed in the channel cross section of the ink channel 40. In this case, the nozzle diameter may be slightly smaller than the diameter of the channel cross section in consideration of the positional deviation of the nozzle plate during its adhesion.

To the other end (rear end) of the actuator base plate 32 and the plat member 34, the manifold member 37 is bonded. In a part of the manifold member 37, an ink supply port 31 is formed for the supply of ink from an ink cartridge 4. The manifold member 37 forms a common ink channel 39 communicating with all of the ink channels 40. When the ink channel 40 increases in capacity, the manifold member 37 feeds ink to the expanded ink channel 40.

Figure 5:
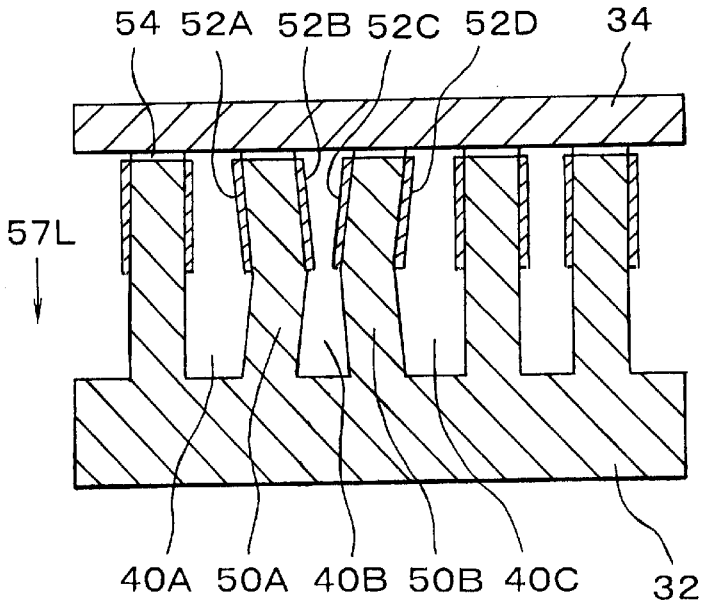
FIG. 5 is an explanatory cross sectional view showing the ink channels during the operation of the ink jet head.
Figure 6:
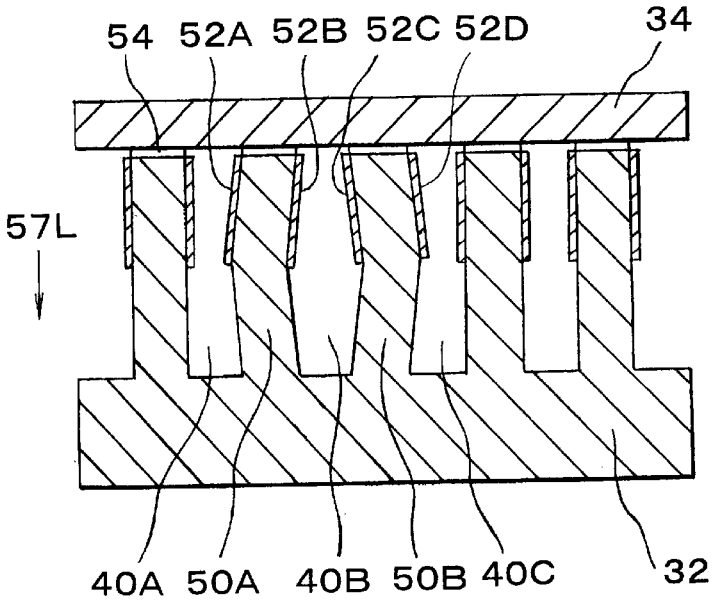
FIG. 6 is an explanatory cross sectional view showing the ink channels during the operation of the ink jet head.

In the foregoing structure, the actions of the ink jet head will be described. When the ink jet recorder is to perform printing, as shown in FIGS. 5 and 6, a specific ink channel 40B is selected in accordance with print data given. Electrodes 52B and 52C of the selected ink channel 40B are grounded, and a drive voltage is applied to electrodes 52A and 52D of ink channels 40A and 40C located on both sides of the ink channel 40B. Drive electric fields heading toward the ink channel 40B are generated in side walls 50A and SOB of the ink channel 40B, whereby the polarized side walls 50A and 50B bent toward each other because of a piezoelectric thickness shear effect. Since the ink channel 40B decreases in capacity owing to the bending of both side walls 50A and 50B, ink in the ink channel 40B is pressurized. As a result, the ink is ejected through the nozzle 30 as ink droplets.

When the drive voltage is stopped afterwards, the side walls 50A and 50B return to their state before bending, whereupon the ink pressure in the ink channel 40B lowers. Thus, ink in the common ink channel 39 is fed into the ink channel 40B to replenish ink in an amount corresponding to the amount of the ejected ink droplets and make the ink channel 40B ready for the next ejection of ink droplets.

When the direction of polarization is reversed or the direction of the electric field is reversed, the side walls 50 can be deformed in a direction in which the ink channel 40 expands. This is another constitution that may be effected. As a result, ink is fed to the ink channel 40 from the common ink channel 39. Then, the electric field applied to the side walls 50 is eliminated, whereupon the side walls return to their original straight form. By this return action, the ink in the ink channel 40 is pressurized, whereby ink droplets are ejected through the nozzle 30. A plurality of methods for varying the capacity of the ink channel 40 may be combined to stabilize the ejection of ink droplets or control the volume or the flying speed of ink droplets.

Figure 7:
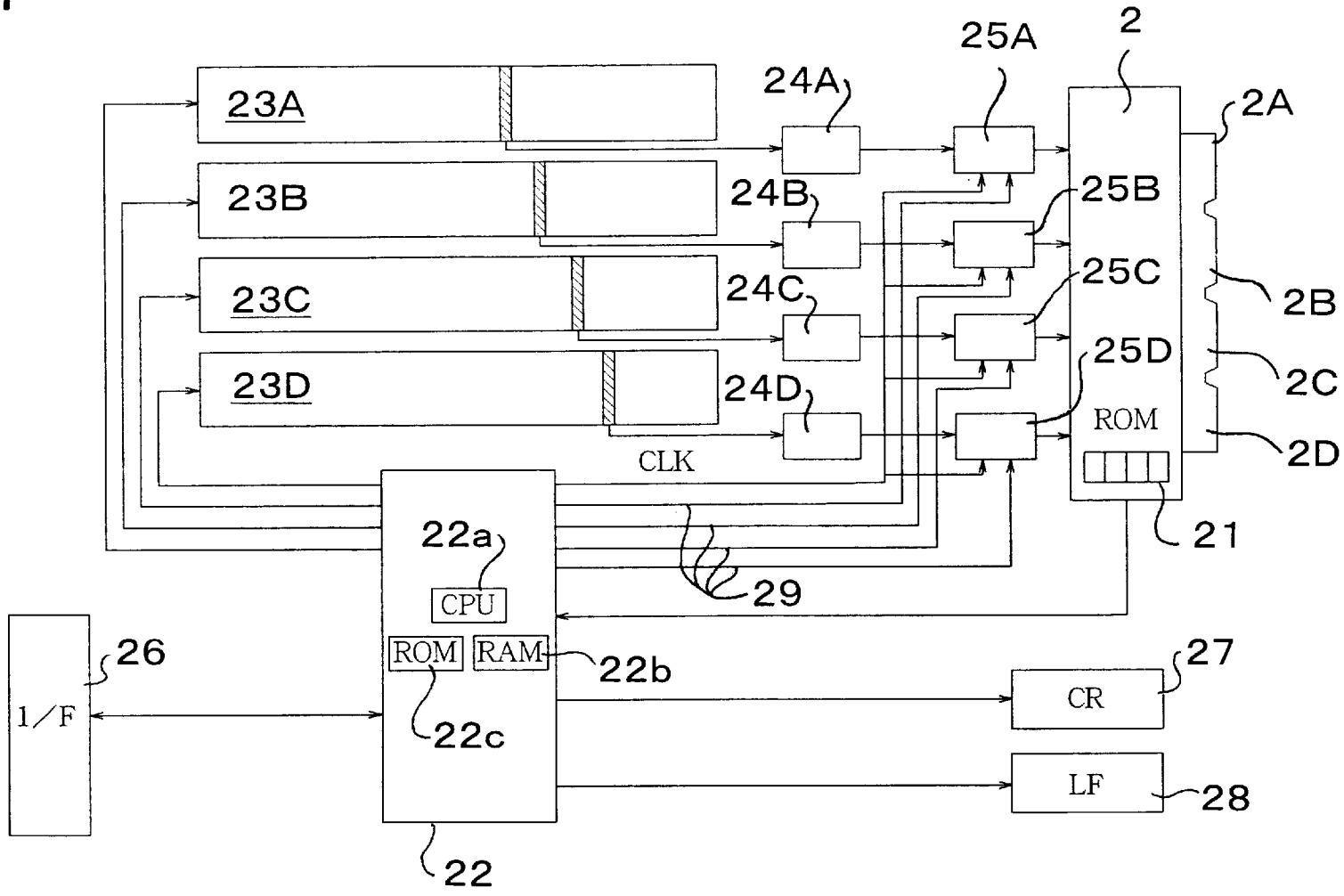
FIG. 7 is a block diagram of control part of the ink jet printing apparatus according to the invention.

A control circuit 20 of the ink jet printer 1 is explained with reference to FIG. 7. The ink jet head assembly 2 has ROM 21 storing characteristic data for the ink jet head assembly 2 such as data of the ejecting speed of droplets. As described above, because the ink jet head assembly 2 is comprised of four heads, ROM 21 has four areas corresponding to the four heads and data corresponding to each head is written in each respective area. When the ink jet head assembly 2 is installed in the ink jet printer 1, CPU 22*a* comprising a controller 22 of the control circuit 20 reads data from ROM 21. CPU 22*a* controls the ejection timing based on the read data.

The ink jet head assembly 2 is usually fixedly supported by a holder part (not shown) with the manifold 37. The holder part is detachably mounted to the carriage 3. Therefore, the ink jet head assembly 2 and the holder part are removed from the carriage 3 as one body to exchange the ink jet head 2. By mounting ROM 21 on the bottom wall part of the holder part, ROM 21 can be mounted detachably on the carriage 3 as one body with the ink jet head 2. Therefore, when the ink jet head assembly 2 is exchanged for some reason, the ejection timing is controlled for the new ink jet head assembly 2 in the same way as for the exchanged ink jet head 2, whereby no problem occurs by exchanging the ink jet head.

The controller 22 has image buffers 23A, 23B, 23C and 23D corresponding to the four ink jet heads 2A, 2B, 2C and 2D. The print data sent from a computer (not shown) via an interface 26 is temporally stored in the image buffers 23A–23D. The print data stored in each image buffer 23A–23D is read by a reading circuit 24A, 24B, 24C and 24D respectively and sent to a driver circuit 25A, 25B, 25C and 25D respectively.

Other than a clock signal (CLK) that is a standard of the ejection timing, a signal for adjusting the ejection timing is input from CPU 22*a* to the driver circuit 25A, 25B, 25C and 25D. Each driver circuit 25A–25D outputs to the corresponding ink jet head 2A–2D the driving voltage based on the print data at a timing corresponding to the signal from CPU 22*a*. When the driving voltage is applied to the ink jet head 2A–2D, the ink droplets are ejected from the nozzle 30, as described above.

RAM 22*b* for storing data read from ROM 21 mounted on the head 2 and ROM 22*c* for storing control programs for the printer 1 are provided to the controller 22 other than CPU 22*a*. CPU 22*a* sends/receives various data to/from computers (not shown) via the interface 26, and controls driving of a carriage driving motor 27 and a paper feeding motor 28.

When a fixed driving voltage is applied to a plurality of ink jet heads 2, the ink droplets are ejected from the nozzle 30 at a fixed ejection speed if the size of the ink channels 40 or the nozzles 30 is same. Although the ink channels 40 and the nozzles 30 are manufactured so that their size becomes within a predetermined range of tolerance, there is variation in their size. Because of the variation in their size, the ejection speed of the ink droplets is changed even if a fixed driving voltage is applied. If the ejection speed of the ink droplets is changed, the position that the ejected ink droplets reach the paper is changed for each head 2. Whereby, especially when a multi color image is printed by overlapping a plurality of inks, the overlapping position of the inks is not overlapped precisely and the deterioration of the image quality is caused.

Adjusting method for solving the problem caused by the change of the ejection speed of the ink droplets for each ink jet head assembly 2 is explained below. The first step involves measuring the ejection speed of the ink droplets for each ink jet head 2. The ejection speed of the ink droplets can be measured as follows.

The ink jet head assembly 2 is mounted on the carriage 3 and the carriage 3 is moved along the paper at a predetermined space from the paper. Then, the driving voltage is applied to the ink jet head assembly 2 at a predetermined timing to eject droplets. At this time, the actual ejection speed of the ink droplets can be measured by measuring a difference between the adhering position of the ink droplets on the paper obtained theoretically and the adhering position of the ink droplets on the paper that is actually ejected.

The difference in the ejection speed of the ink droplets for each ink jet head assembly 2 can then be obtained. The carriage 3 is moved reciprocately at a fixed speed and the driving voltage is applied at a predetermined standard ejection timing to eject ink droplets. At this time, if the ejection speed of the ink droplets is equal in all ink jet heads 2, the adhering position of the ink droplets on the paper becomes same in all ink jet heads 2.

On the other hand, if the ejection speed of the ink droplets ejected any one of the ink jet heads 2 is different from the ejection speed of the ink droplets ejected another ink jet head 2, the adhering position becomes different. By measuring the difference of the adhering position, the difference of the ejection speed of the ink droplets can be obtained.

Because the direction of the ink ejection is a direction of the vector sum of the movement speed of the ink jet head assembly 2 and the ejection speed of the ink droplets, the difference of the adhering position is generated. Therefore, if the movement speed of the ink jet head assembly 2 is fixed (or constant), the ejection speed of the ink droplets can be measured without considering the affect of the movement speed of the ink jet head assembly 2 relative to the ejecting direction of the ink droplets.

The second step in the adjusting method includes the timing for applying a driving voltage for ink ejection in the ink jet head assembly 2 that ejected ink droplets which is determined based on the ejection speed of the ink droplets obtained by the first step. The determining method is explained with reference to FIGS. 8A and 8B.

Figures 8A, 8B:
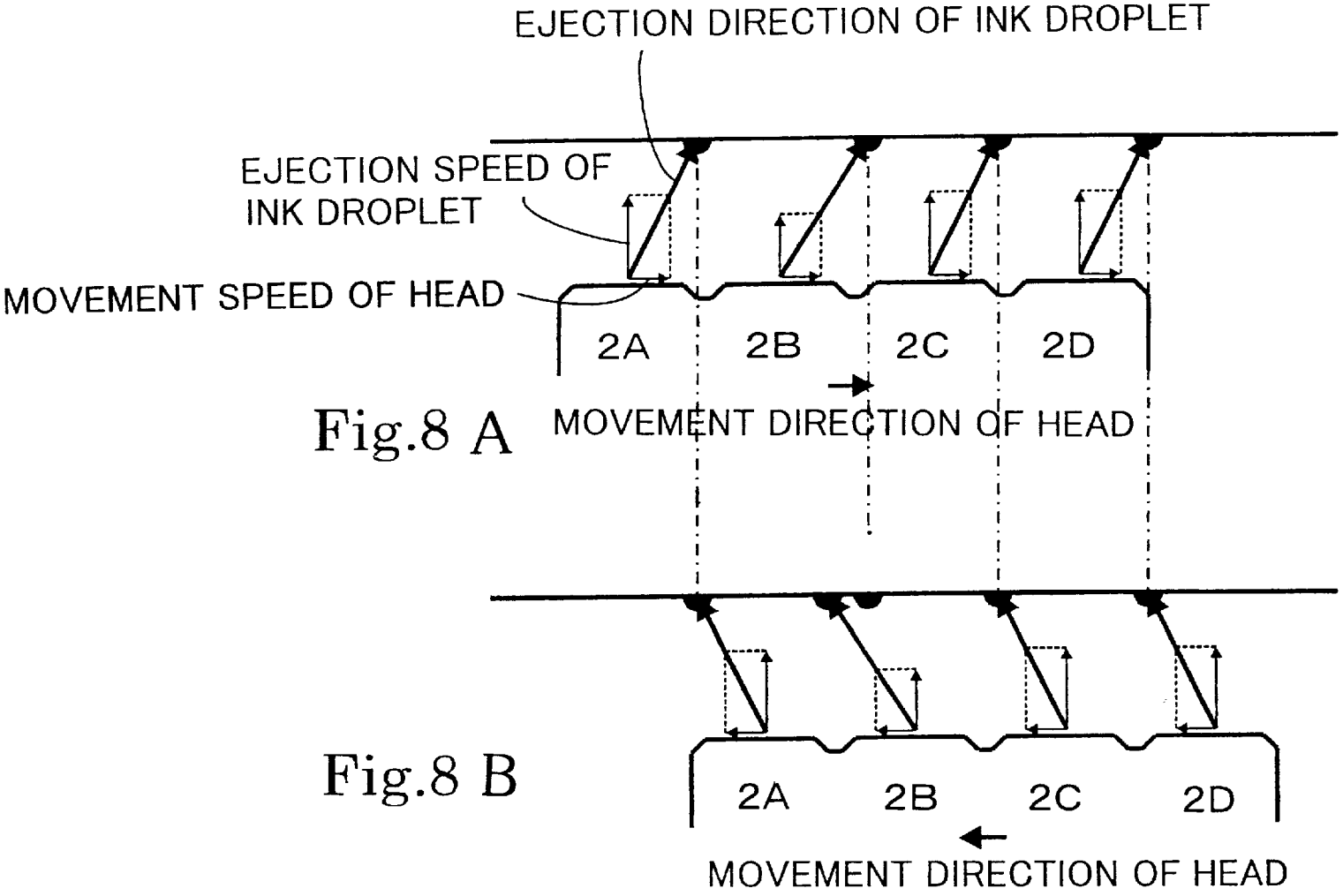
FIG. 8A and 8B are explanatory diagrams of ink ejecting operation of the ink jet printing apparatus.

FIGS. 8A and 8B show a condition that the ink droplets ejected from the ink jet head assembly 2 adhere onto the paper, and specifically show an example which the ejection speed of the ink droplets ejected from the ink et head 2B is slower than the ejection speed of the ink droplets ejected from other ink jet heads 2A, 2C and 2D. FIG. 8A shows this condition when the ink jet head assembly 2 moves in one direction, and FIG. 8B shows this condition when the same ink jet head assembly 2 moves back in the opposite direction.

As seen from FIGS. 8A and 8B, because the ejection speed of the ink droplets ejected from the ink jet head 2B is slow, the adhering position on the paper of the ink droplets ejected from the ink jet head 2B that moves in one direction is different from that of the ink droplets ejected from the ink jet head 2B that moves back in the opposite direction.

In this case, the ejection timing of the ink droplets of the ink jet head 2B is quicker compared to the timing of the ejection timing of the ink droplets of the other ink jet heads 2A, 2C and 2D. That is, after the driving voltage is applied to the ink jet head 2B, the driving voltage is applied to the ink jet heads 2A, 2C and 2D.

When the ejection speed of the ink droplets ejected from a selected ink jet head is faster than the ejection speed of the ink droplets ejected from other ink jet heads, the ejection timing of the ink droplets of the selected ink jet head is delayed compared to the ejection timing of the ink droplets of the other ink jet heads.

The ink droplets ejected from either one of the ink jet heads can be adhered onto the same position when moving in one direction and moving in its opposite direction by determining the ejection timing as described above.

The third step in the adjusting method includes data corresponding to the ejection timing determined in the second step, is stored in ROM 21 that is uniformly installed to the ink jet head 2. In the ink jet heads 2A–2D corresponding to each color as is in this preferred embodiment, data corresponding to the ejection timing for each head 2A–2D is stored therein. The data, includes the ejection speed of the ink droplets, data of ejection speed difference of the ink droplets in each ink jet head, or data of ejection timing difference based on the ejection speed difference, can be stored in ROM 21 to obtain same effects.

The ink droplet ejecting operation of printing operation using the ink jet head assembly 2 wherein the ejection timing of the ink droplets is adjusted as explained above, is explained further, below.

CPU 22*a* reads data of the ejection timing stored in ROM 21. CPU 22*a* outputs a signal ordering the ejection timing based on the read data to the driving circuits 25A–25D. The driving circuits 25A–25D apply the driving voltage to an electrode 52 provided on the ink jet head assembly 2 based on the signal from CPU 22*a*. The ink droplets are ejected from the nozzle 30 of the ink jet head assembly 2 as described above.

The ejecting operation of the ink droplets by the ink jet head assembly 2 wherein the ejection timing is adjusted is explained with reference to FIGS. 9A, 9B, 9C and 9D. In this example, data is stored in ROM 21 so that the ink is ejected from the ink jet head 2B at a faster timing than the ink jet heads 2A, 2C and 2D.

Figures 9A, 9B, 9C, 9D:
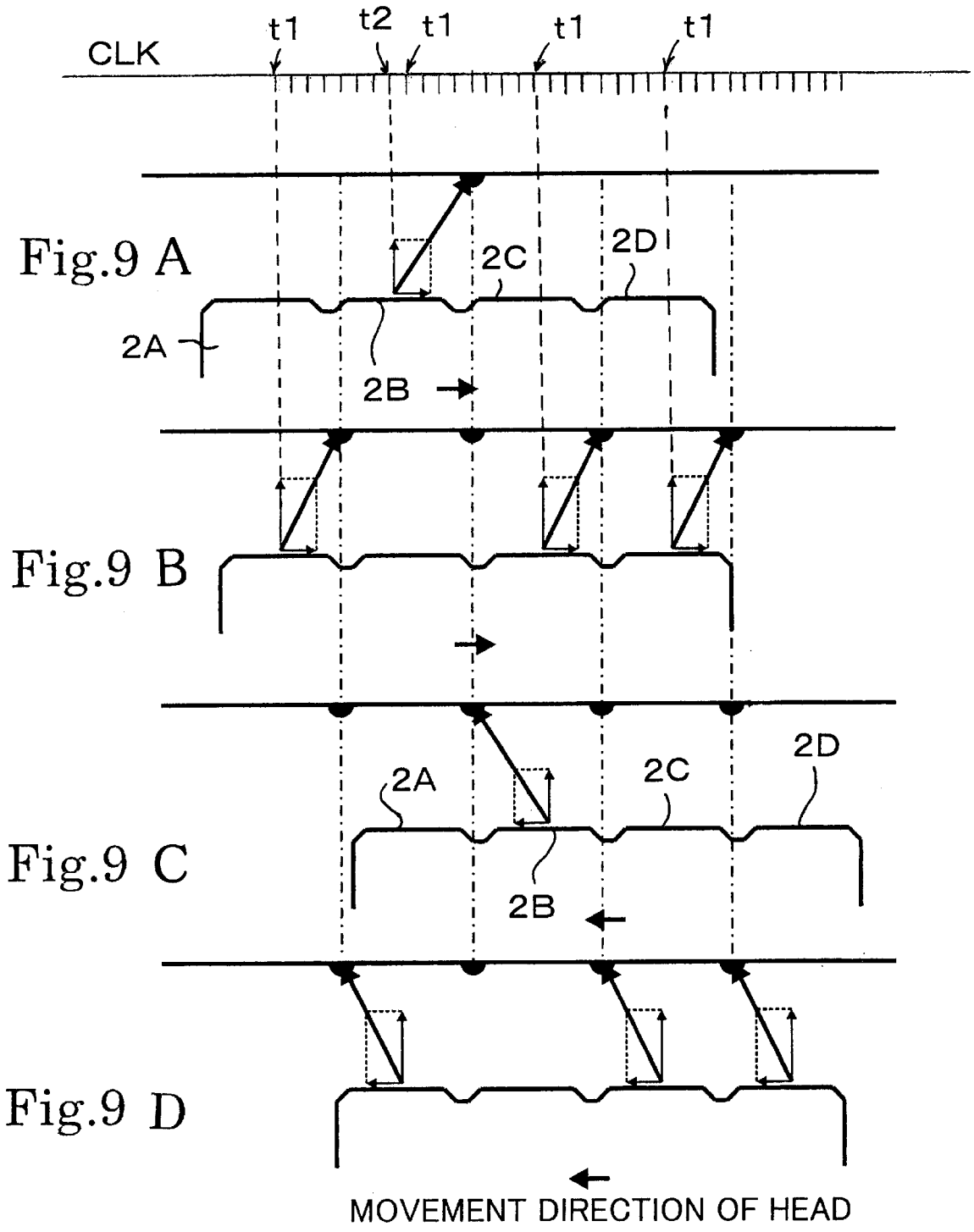
FIGS. 9A, 9B, 9C and 9D are explanatory diagrams of ink ejecting operation of the ink jet printing apparatus according to the invention.

Only the ink jet head 2B ejects ink droplets at the timing t2 as shown in FIG. 9A when the ink jet head assembly 2 moves in one direction. The ink jet heads 2A, 2C and 2D eject ink droplets at the timing t1 after predetermined time passed from the timing t2 (after one graduation of the time scale shown in the upper part has passed), as shown in FIG. 9B.

The ink jet head assembly 2 can be adjusted so that the adhering position on the paper of the ink droplets ejected from all ink jet heads 2 becomes precise by shifting the ejection timing of the ink jet head whose ejection speed of the ink droplets is different from other ink jet heads.

When the ink jet head moves back in the opposite direction, as shown in FIG. 9C, only the ink jet head 2B ejected ink droplets and the ink jet heads 2A, 2C and 2D eject ink droplets at a time after a predetermined time has passed (after one graduation of the time scale shown in the upper part has passed in this example), as shown in FIG. 9D. Because the ejection timing of a selected ink jet head is made quicker by a predetermined time compared to other ink jet heads when moving in one direction and moving back in its opposite direction, the ink droplets can be adhered onto a precise position. Therefore, the problems caused by the difference of the ejection speed of ink droplets in the selected ink jet head and other ink jet heads can be prevented and stable printing quality can be obtained.

Thus, in the ink jet printer I provided with the ink jet head assembly 2 adjusted as described above, when the ink jet head assembly 2 moves reciprocately to eject ink droplets, the ink droplets are ejected at the ejection timing so that the ejected ink droplets are adhered onto almost the same position when moving in one direction and moving back in its opposite direction. Especially in the ink jet printer 1 being capable of printing with multi color, the ink jet heads 2 are adjusted so that the ejection timing becomes appropriate for each ink jet heads 2A, 2B, 2C and 2D corresponding to each color and data for determining the ejection timing is stored in ROM 21. As a result, when the ink jet heads 2A–2D move reciprocately to eject ink droplets, the adhering position of ink droplets of each color is almost same, and therefore, the printing quality can be increased.

When there is a variation in the size of the ink channels 40 or the nozzles 30 of the ink jet head 2, the ejection speed of the ink droplets ejected from the nozzle 30 will be changed because of the variation. However, the effect of the change of the ejection speed upon the printing quality can be cancelled by determining the ejection timing in consideration of the change of the ejection speed. Therefore, when the ink channel 40 is formed or the nozzle 30 is formed to the nozzle plate 36 in the manufacturing process of the ink jet head 2, it is not necessary to manage the manufacturing process with a strict tolerance and the manufacturing process can become simplified. Since the range of the tolerance can be set large, the fraction of defective parts is decreased and the manufacturing efficiency can be increased.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

For example, the invention can be applied to an ink jet head that ejects ink droplets from the ink channel filled with ink through the nozzle by applying an ejection signal to the actuator. In particular, the invention can be applied to an ink jet head of the bubble jet type wherein the heat generated by a thermal resistor, such as zirconium borate, is applied momentarily to the ink to cause film boiling and eject ink by utilizing the volume expansion of the boiling bubbles.

What is claimed is:

1. An ink jet printing apparatus, comprising:

a plurality of ink jet heads that eject ink droplets onto a printing medium when an ejection signal is applied to each ink jet head according to a predetermined ejection timing;

a memory that stores for each ink jet head at least one of data relating to an ejection speed of ink droplets, data relating to an ejection speed difference between the ink jet heads, and data relating to an ejection timing difference based on the ejection speed; and a controller that applies the ejection signal to each ink jet head at a predetermined ejection time based on the data stored in the memory.

2. The ink jet printing apparatus according to claim 1, wherein the memory is included with the ink jet head and detachable with the ink jet head from the printing apparatus.

3. The ink jet printing apparatus according to claim 2, wherein when the ink jet head is exchanged, the ejection signal is applied to the exchanged ink jet head at a predetermined ejection timing based on the data stored in the memory provided to the exchanged ink jet head.

4. The ink jet printing apparatus according to claim 1, wherein a position of printed dots on the paper is determined by a movement speed of the ink jet head and the ejection speed of the ink droplets.

5. The ink jet printing apparatus according to claim 4, wherein the ejection speed of the ink droplets can be obtained by measuring difference between the position of the printed dots and a theoretical printing position.

6. The ink jet printing apparatus according to claim 5, wherein the movement speed of the ink jet head is constant.

7. The ink jet printing apparatus according to claim 6, wherein if the ejection speed of the ink droplets in a selected ink jet head is different from the ejection speed of the ink droplets in other ink jet heads, the position of the printed dots is different from the predetermined position in one direction when the ink jet head moves in that one direction, or different in a direction opposite to the one direction when the ink jet head moves in the direction opposite to the one direction.

8. The ink jet printing apparatus according to claim 1, wherein a reference ink jet head is determined in advance, such that the ejection speed of the ink droplets ejected from the selected ink jet head can be obtained by obtaining the ejection speed difference between the selected ink jet head and the reference ink jet head.

9. A method for adjusting printing quality in an ink jet printing apparatus having a plurality of ink jet heads that eject ink droplets onto a printing medium when an ejection signal is applied to each ink jet head according to a predetermined ejection timing, comprising:

storing in a memory for each ink jet head, at least one of data relating to an ejection speed of ink droplets, data relating to an ejection speed difference between the ink jet heads, and data relating to an ejection timing difference based on the ejection speed; and applying the ejection signal to each ink jet head at a predetermined ejection time based on the data stored in the memory.

10. The method according to claim 9, wherein the memory is included with the ink jet head and detachable with the ink jet head from the printing apparatus.

11. The method according to claim 10, wherein when the ink jet head is exchanged, the ejection signal is applied to the exchanged ink jet head at a predetermined ejection timing based on the data stored in the memory provided to the exchanged ink jet head.

12. The method according to claim 9, wherein a position of printed dots on the paper is determined by a movement speed of the ink jet head and the ejection speed of the ink droplets.

13. The method according to claim 12, wherein the ejection speed of the ink droplets can be obtained by measuring difference between the position of the printed dots and a theoretical printing position.

14. The method according to claim 13, wherein the movement speed of the ink jet head is constant.

15. The method according to claim 14, wherein if the ejection speed of the ink droplets in a selected ink jet head is different from the ejection speed of the ink droplets in other ink jet heads, the position of the printed dots is different from the predetermined position in one direction when the ink jet head moves in that one direction, or different in a direction opposite to the one direction when the ink jet head moves in the direction opposite to the one direction.

16. The method according to claim 9, wherein a reference ink jet head is determined in advance, such that the ejection speed of the ink droplets ejected from the selected ink jet head can be obtained by obtaining the ejection speed difference between the selected ink jet head and the reference ink jet head.

17. A storage medium for storing programs and data for adjusting printing quality in an ink jet printing apparatus having a plurality of ink jet heads that eject ink droplets onto a printing medium when an ejection signal is applied to each ink jet head according to a predetermined ejection timing, comprising:

a program for storing in a memory for each ink jet head, at least one of data relating to an ejection speed of ink droplets, data relating to an ejection speed difference between the ink jet heads, and data relating to an ejection timing difference based on the ejection speed; and a program for applying the ejection signal to each ink jet head at a predetermined ejection time based on the data stored in the memory.

18. The storage medium according to claim 17, wherein the memory is included with the ink jet head and detachable with the ink jet head from the printing apparatus.

19. The storage medium according to claim 18, wherein when the ink jet head is exchanged, the ejection signal is applied to the exchanged ink jet head at a predetermined ejection timing based on the data stored in the memory provided to the exchanged ink jet head.

20. The storage medium according to claim 17, wherein a position of printed dots on the paper is determined by a movement speed of the ink jet head and the ejection speed of the ink droplets.

21. The storage medium according to claim 20, wherein the ejection speed of the ink droplets can be obtained by measuring difference between the position of the printed dots and a theoretical printing position.

22. The storage medium according to claim 21, wherein the movement speed of the ink jet head is constant.

23. The storage medium according to claim 22, wherein if the ejection speed of the ink droplets in a selected ink jet head is different from the ejection speed of the ink droplets in other ink jet heads, the position of the printed dots is different from the predetermined position in one direction when the ink jet head moves in that one direction, or different in a direction opposite to the one direction when the ink jet head moves in the direction opposite to the one direction.

24. The storage medium according to claim 17, wherein a reference ink jet head is determined in advance, such that the ejection speed of the ink droplets ejected from the selected ink jet head can be obtained by obtaining the ejection speed difference between the selected ink jet head and the reference ink jet head.

* * * * *